US007809147B2

(12) United States Patent
Giannetti

(10) Patent No.: US 7,809,147 B2
(45) Date of Patent: Oct. 5, 2010

(54) OSSEOUS CONDUCTION ACOUSTIC TRANSDUCER

(75) Inventor: Marco Giannetti, Rome (IT)

(73) Assignee: COS.EL.GI S.p.A., Pomezia (IT)

( * ) Notice: Subject to any disclaimer, the term of this patent is extended or adjusted under 35 U.S.C. 154(b) by 1135 days.

(21) Appl. No.: 11/418,375

(22) Filed: May 4, 2006

(65) Prior Publication Data

US 2008/0273731 A1 Nov. 6, 2008

(30) Foreign Application Priority Data

May 4, 2005 (IT) ..... RM2005A0211

(51) Int. Cl.
*H04R 25/00* (2006.01)

(52) U.S. Cl. ..... 381/151; 381/326; 381/380

(58) Field of Classification Search ..... 381/326, 381/327, 330, 151, 380, 381, 396, 417
See application file for complete search history.

(56) References Cited

U.S. PATENT DOCUMENTS 2,077,425 A * 4/1937 Lieber ..... 381/151
2,459,325 A * 1/1949 Knowles ..... 381/151
2,482,044 A * 9/1949 Vernier ..... 381/151
6,141,427 A 10/2000 Fukuda
2003/0012395 A1 1/2003 Fukuda

FOREIGN PATENT DOCUMENTS

| | | |
|---|---|---|
| JP | 2003244782 | 8/2003 |
| JP | 2004274593 | 9/2004 |
| KR | 2001-003563 | 1/2001 |
| WO | WO 02/25989 | 3/2002 |

* cited by examiner

*Primary Examiner*—Huyen D Le
(74) *Attorney, Agent, or Firm*—Knobbe Martens Olson & Bear LLP

(57) ABSTRACT

Transducer substantially comprising a hollow housing, a device located inside the hollow housing to transform the electrical signals output by a vibration pickup microphone, a generally discoid shaped element for acoustical coupling with the mastoid bone, having one face directed to the outside of the housing and one face arranged onto the inside of the housing itself, and a coupling element for connection between the vibrating unit and the acoustic coupling element. The acoustic coupling element comprises one soft material headset apt to close and seal one opening made on one face of the hollow housing, and to hold the vibrating element freely hanging into said housing, by means of the coupling element.

16 Claims, 6 Drawing Sheets

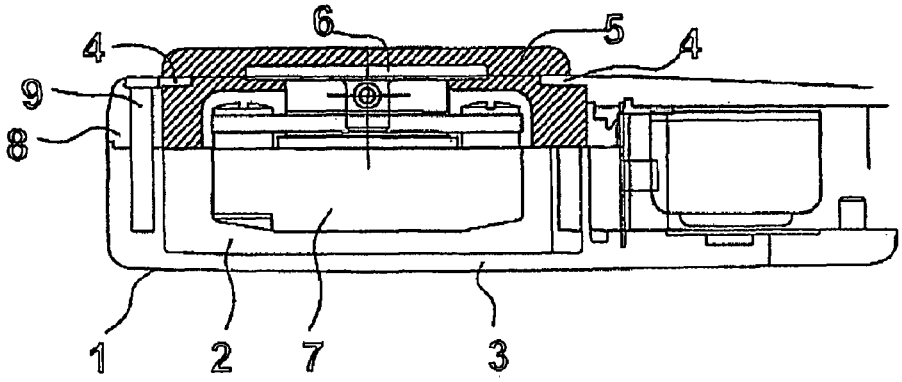
Fig. 1
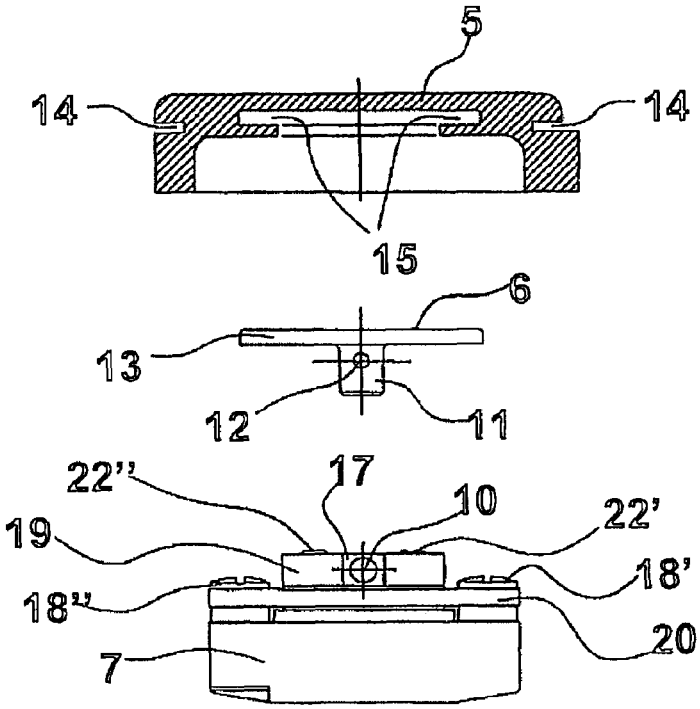
Fig. 2
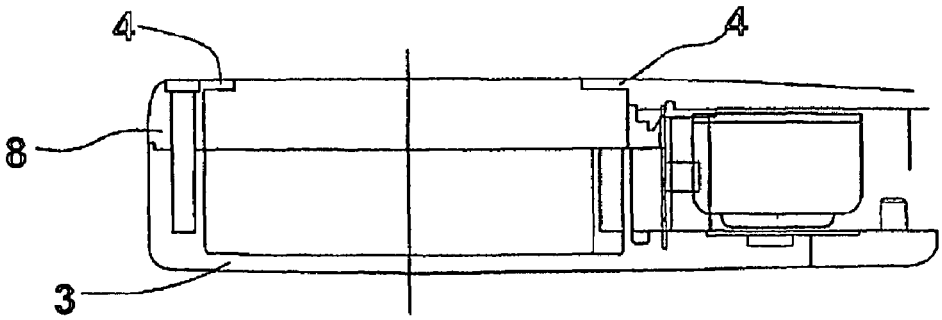

OSSEOUS CONDUCTION ACOUSTIC TRANSDUCER

FIELD OF THE INVENTION

The present invention relates to an acoustic osseous conduction transducer and, more particularly, relates to a transducer that for example, but not exclusively, can be employed in acoustic sets for people suffering from hearing defects, particularly acoustic sets fitted into spectacles legs and the like, the transducer being especially light and easy to wear even for long periods.

STATE OF THE ART

Acoustic osseous conduction transducers to be used, or proposed to be used, in many fields, such as portable telephones, integrated communications systems for headsets, helmets and the like, or in telephone terminals integrated in headrests of car seats, etc., are known. Such a transducer has been of interest for the acoustic prosthesis field, particularly the field of transducers enclosed in spectacles. In this case, the transduction assembly is inserted into hard plastic shells, enclosed into the ending part of a spectacles leg so that it will be located at the mastoid bone. The transducer, provided with elements for picking up sounds and with circuits for processing them into electrical signals, has a vibrating element assimilable to a loudspeaker, which transforms those signals processed by the processing circuits in vibrations trans-mitted to the mastoid bone and from this to the internal ear, allowing the sound to be properly received.

Some of the advantages offered by such a device are that, for example, they are not easily detectable and thereby do not show the wearer's dysacousia, and are light and effective; however they do need to be strongly pressed against the mastoid bone, which would lead to a quick stiffening of the part in consequence of the container stiffness contacting the mastoid and, hence, to intolerance by wearers, who won't be using such devices for long periods. As it will be shown below, they are further complicated and weak in construction. In order to prevent damaging by dust, sweat and the like, which could otherwise get into the plastic shell, they need for example to have sealing elements to seal from the outside environment the inner part of the device, containing the transducer, the processing circuits and the like. However, as these components are more and more miniaturized, sealing elements, or more generally gaskets, of this kind are very thin and weak, and liable to be easily damaged or deformed during the assembly process, being therefore unable to perform their function.

Examples of transducers of the above mentioned kind are disclosed in US patent application 2003/0012395 A1, which discloses a vibration generating element substantially constituted by a toroidal element carrying a magnet with a winding running about it, said assembly hanging (by means of a vibrating element comprising a foil integral with the toroidal element) within a container, contacting the mastoid bone. The toroidal element is in turn connected to one dampening element, also integral with the outside container, comprised by one foil and a resilient block.

Patents, or patent applications, such as WO0225989, JP2004274593, JP2003244782, KR001003563, U.S. Pat. No. 6,141,427 disclose other osseous conduction transducers of different types.

Because of the device geometry and its manufacturing method, in all these examples the external container is made of a generally thermosetting stiff material; further, the device has to be pressed using up to over 200 g force to get a good sound transmission. As already previously mentioned, this pressure, together with the stiffness of the container, leads to the stiffening of the part and to intolerance to wearing the device.

Moreover, in consequence of the many components required, the delicacy of some of them and the consequent complexity of the assembly process, the device is expensive and easy to damage.

SUMMARY OF THE INVENTION

The present invention aims to overcome such drawbacks providing a new transducer comprising few parts, easy to assemble and disassemble for maintenance purposes, comfortable to wear and reliable.

This new transducer substantially comprises (i) a hollow housing; (ii) a device placed within the hollow housing, for transforming the electrical signals emitted by a vibration picking up microphone (hereinafter referred to as "vibrating unit" for sake of simplicity); (iii) an element for the acoustic coupling with the mastoid bone, generally discoid in shape and having an outwardly directed face facing the housing and one face arranged toward the inner part of the housing itself; and, (iv) an element for connecting the vibrating element and the acoustic coupling element. In this transducer according the present invention, the acoustic coupling element is comprised by one soft material headset, to close and seal an opening made onto one hollow housing element and supporting, by means of the connecting element, the vibrating unit freely hanging within said housing. According to the present invention, the hollow housing it is not a standing alone component but is part of a device, such as a pair of spectacles, a helmet, a cellular telephone, worn or otherwise employed by the user.

DETAILED DISCLOSURE OF PREFERRED EMBODIMENTS OF THE INVENTION

The present invention will be now described in more detail with respect to preferred embodiments thereof, given by way of non limiting example, illustrated in the appended figures, wherein:

FIG. 1 shows, partly in section, one first embodiment of the present invention inserted into the ending part of the leg of a pair of spectacles;

FIG. 2 shows an "exploded" view of the device of FIG. 1;

Figure 3:
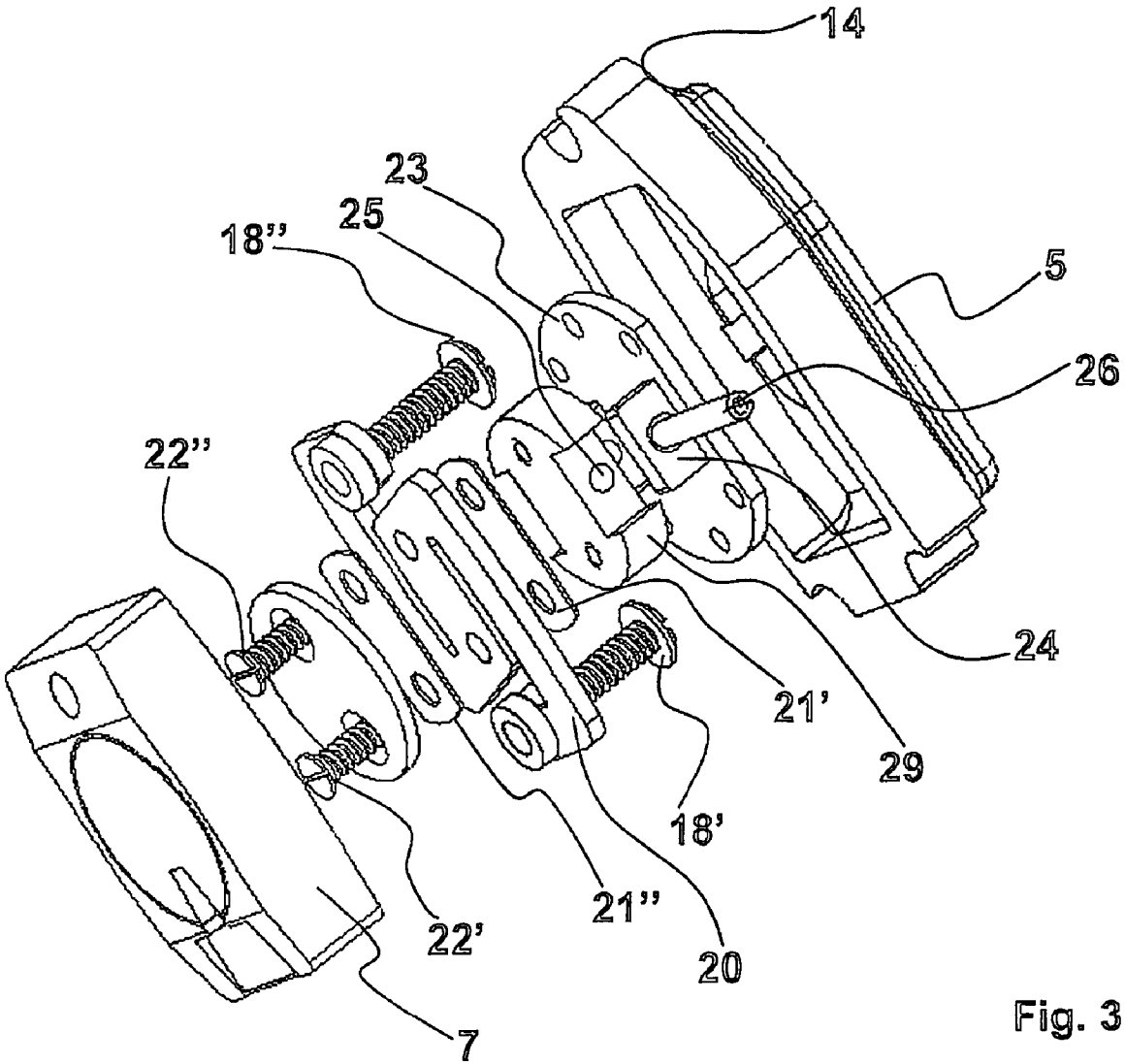
FIG. 3 shows an "exploded" view of a second embodiment of the device of the invention.

Referring to FIG. 1, the transducer according to the present invention, formed by the assembly of the following parts, a vibrating unit 7, a connecting element 6 made of plastic or a metal, for example steel, and a headset 5, is fitted within a housing 1 (forming for instance the ending part of a spectacles leg) comprised by the shell 3 having a generally U- shaped cross-section defining therein a cavity 2, and by a generally annular shaped element 8 mounted onto the shell 3 and coupled to it by the at least one screw 9. Within its terminal part farthest from the shell 2, the annular element 8 carries an annular flange 4. The headset 5 closes and seals cavity 2 by the introduction into the annular flange 4; the coupling will be discussed in more detail below with reference to FIG. 2. Onto its face internal to cavity 2, headset 5 carries a housing (shown hereinafter with reference to FIG. 2), wherein coupling element 6 is housed.

FIG. 2 shows in an exploded view the arrangement of the element 8, for closing the shell 3, provided with the flange 4, with respect to the vibrating unit 7, the coupling element 6, and the headset 5. Coupling element 6 is made of a flat plate 13, below and centrally carrying a peduncle 11 provided with a preferably threaded gap or hole 12. The flat plate 13 is inserted in the housing or seating 15, obtained in the lower face of the headset 5, whereas peduncle 11 is inserted in cavity 17 made within the plaque 19 and herein locked by a screw, not shown, placed in hole 10 as far as to engage, for example by screwing, in the gap 12 of the peduncle 11. Plaque 19 is secured to a flat spring 20 by means of two screws 22', 22", and the spring 14 is in turn secured to the upper part of vibrating unit 7 by means of two screws 18', 18". Two gaskets or packings 21', 21", better shown in FIGS. 3 to 7, are possibly provided.

Once the vibrating unit 7 by means of element 6 has been set onto the lower face of headset 5 facing the inner part of cavity 2, the headset is mounted on annular element 8 by inserting flange 4 thereof in annular cavity 14 of headset itself. As it is apparent from FIGS. 1 and 2, the relatively large size of headset 5, the depth of cavity 14, the presence of the stiff element 6 engaged in housing 15, make headset 5 a very effective sealing element to prevent dust, moisture, sweat and the like to get in cavity, damaging sensitive transducer's elements placed in said cavity 2. Such a lining or sealing function is facilitated in that headset 5 according to the present invention is usefully and advantageously made from a soft material, for instance from thermoplastic elastomers (TPE). Examples of these materials are Santoprene, Vyram, Marfran, etc.

Referring in particular to embodiments of FIGS. 3 to 7, some further variations of coupling element 6 in the embodiment of FIGS. 1 and 2 are illustrated. Those parts of the device of the invention that are similar in the various embodiments are referred to with similar reference numbers.

The embodiment in FIG. 3 shows one flat plate 23 corresponding to flat plate 13 in FIG. 2, intended to be inserted into the housing 15. It has two flanges 24', 24" provided each with respective holes. Block 29, corresponding to plaque 19 in FIG. 2, has one hole 25 coaxial with the two flanges 24', 24". In the assembled position of the transducer of the invention, block 29 is drawn near to flat plate 23 so that hole 25 lines up to the two holes of flanges 24', 24", and one elastic pin 26 is inserted into the holes so as to make integral block 29 and flat plate 23. Remaining parts are secured in the same way as corresponding elements of embodiment in FIGS. 1 and 2.

Figure 4:
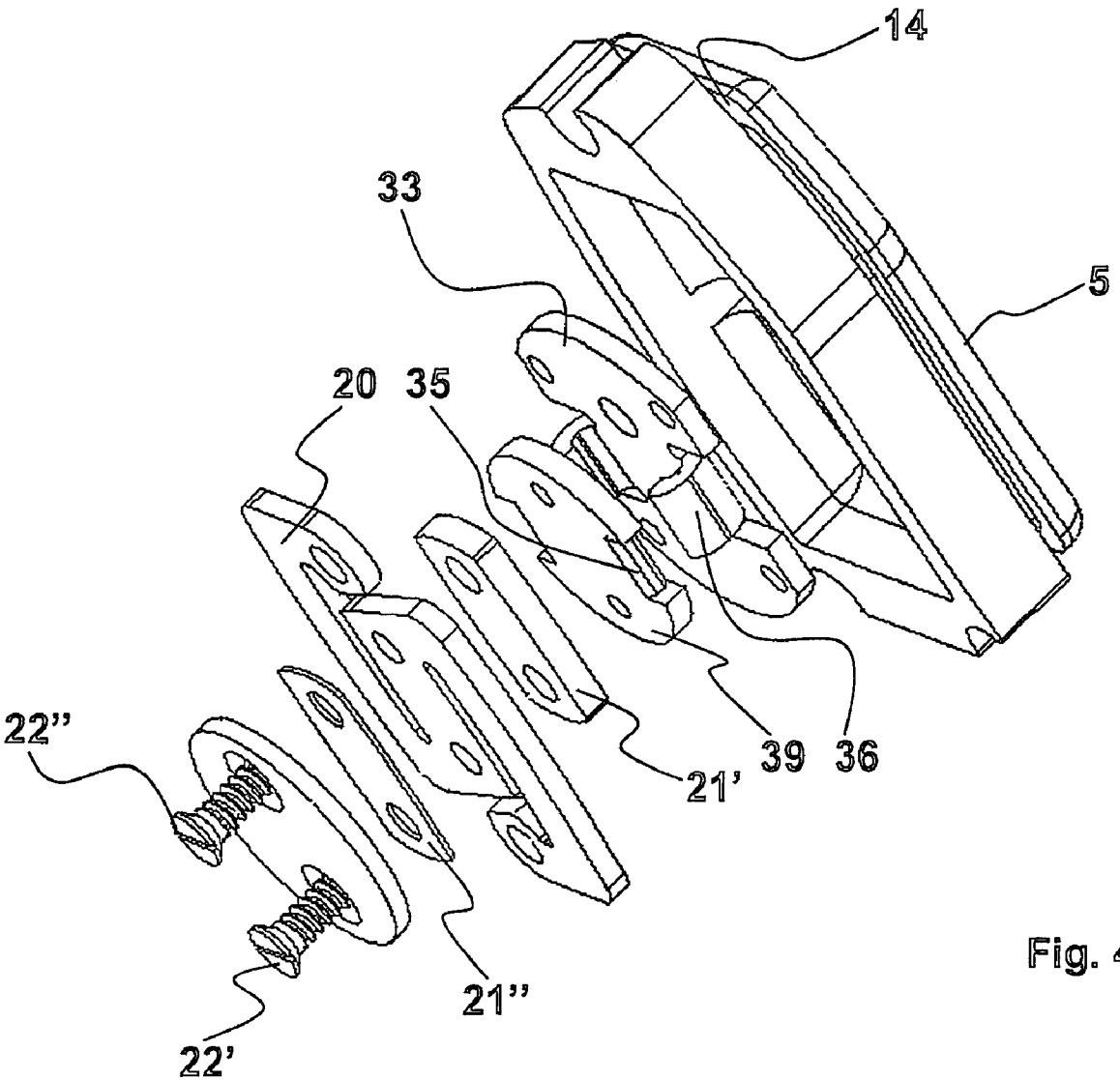
FIG. 4 shows an "exploded" view of a further embodiment of the device of the invention.

The embodiment illustrated in FIG. 4 shows one flat plate 33 provided with two elastic side flanges or tabs 36 provided with two teeth or hooks at their ends, away from flat plate 33. The plaque or block 39 has two seats 35 wherein the two side tabs 36 of the flat plate 33 come and hook. By widening tabs 36 and separating plaque 39 and flat plate 33 it is possible to disassemble such a transducer.

Figure 5:
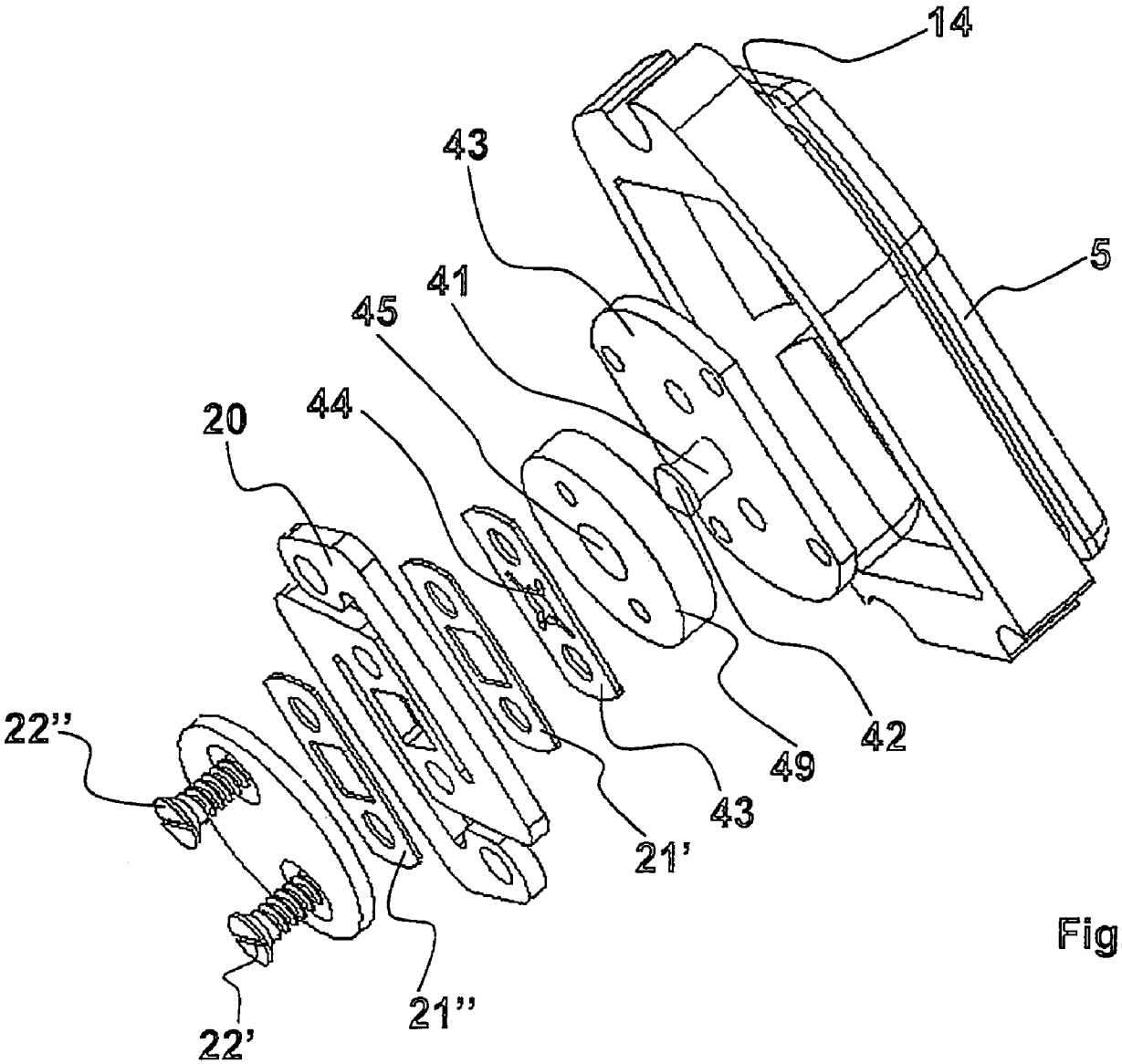
FIG. 5 shows an "exploded" view of a further embodiment of the device of the invention.

The embodiment illustrated in FIG. 5 shows a flat plate 43 provided with a peduncle 41 whose end is of greater sizes, substantially in form of a hat 42 or a mushroom's head. The block or plate 49 has a central hole 45 having a greater diameter than peduncle 41 and hat 42, so that it can be easy to pass through hole 45. Another plaque 43, provided with a second hole or slot 44 whose diameter is smaller than hat 42, is placed at the side of the plate 49 opposed to the side wherein flat plate 43 is secured. Hole 44 has peripheral radial notches to give the peripheral part of hole 44 such a flexibility to allow hat 42 to pass through it in order to be engaged and disengaged from hole 44 using a proper force, which is greater than the force generated during transducer operation.

Figure 6:
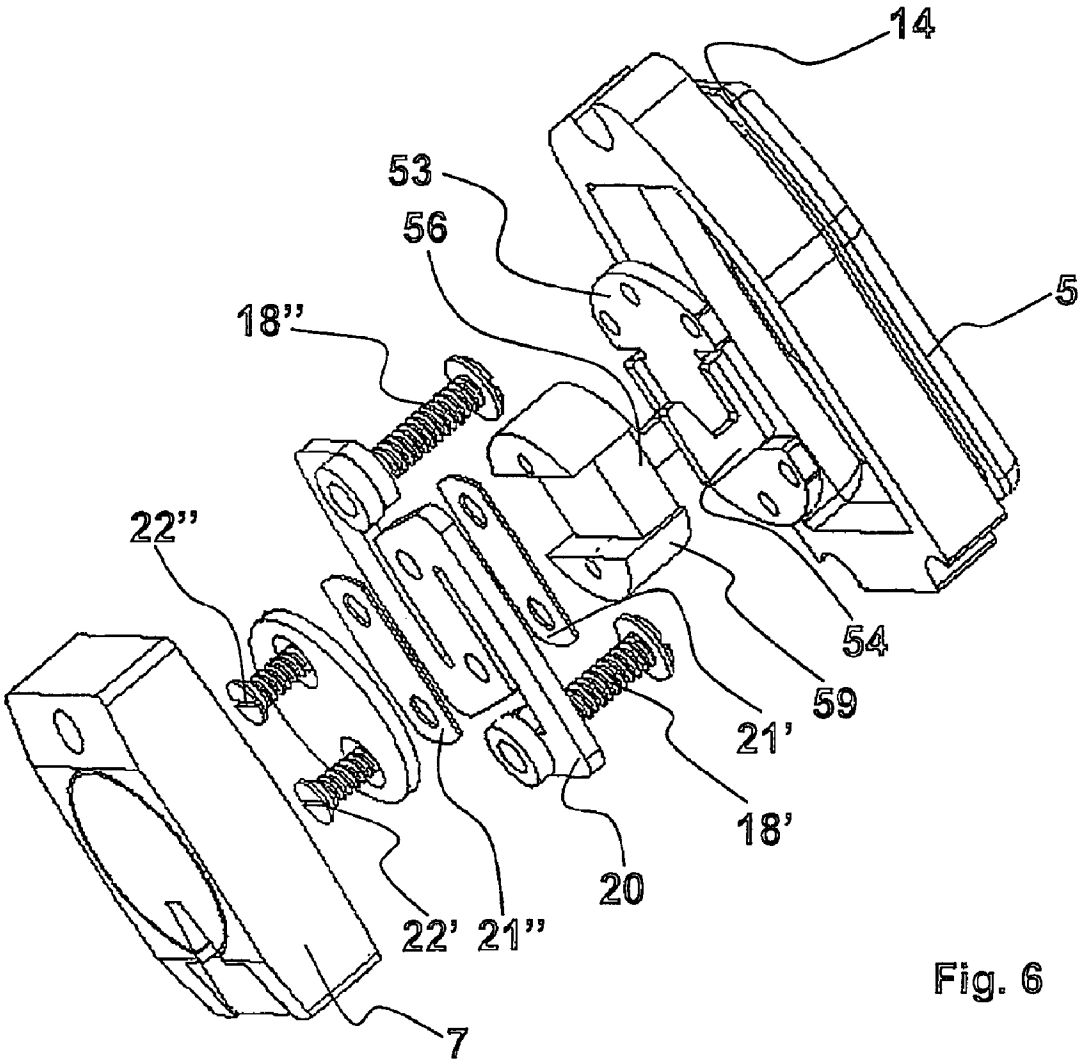
FIG. 6 shows an "exploded" view of a further embodiment of the device of the invention.

The embodiment illustrated by FIG. 6 shows a flat plate 53 provided with two side hooks or winglets 54 for the fixing in two complementary gaps 56 into the plate or block 59. To perform fixing of the plate 53 with the block 59 the two winglets 54 are bent, e.g. by 90° onto the block 59.

Figure 7:
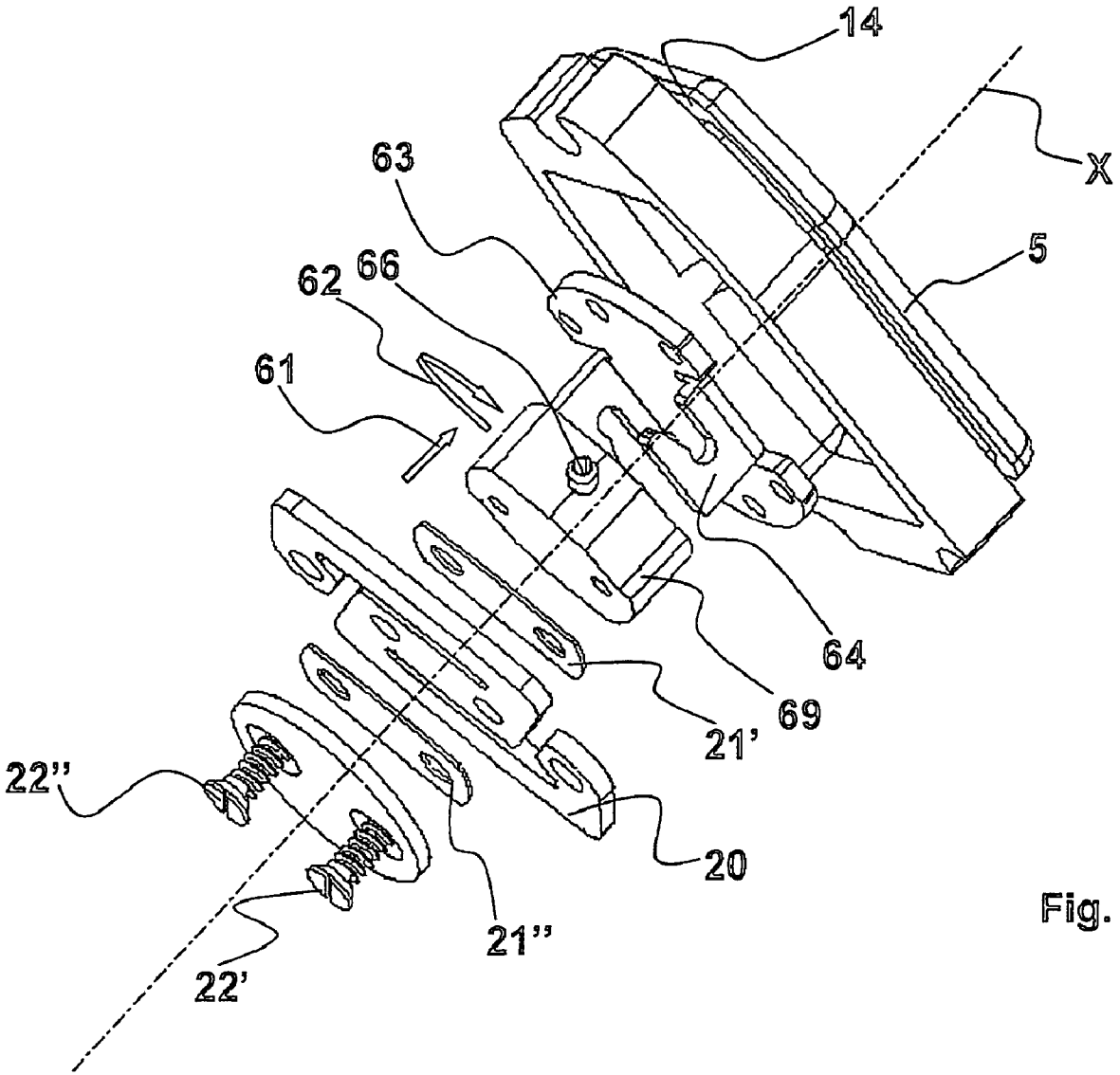
FIG. 7 shows an "exploded" view of a further embodiment of the device of the invention.

The embodiment illustrated by FIG. 7 shows a flat plate 63 provided with two side hooks 64 wherein a pin 66 projecting from block 69 is fixed. Assembling is made moving block 69 with respect to plate 63, first in a translating direction, parallel to axis X-X of the transducer, and then in a rotary direction about axis X-X, as schematically indicated by arrows 61 and 62. Disassembly is made by performing the same two motions in opposite direction.

As it is apparent, in addition to the above mentioned benefits, according to the present invention it is possible to obtain some other important advantages. For example, thanks to the fact that it is necessary to have only the headset 5 and the element 6 in addition to the vibrating unit 7, the manufacturing and assembling processes of the transducer according to the present invention are particularly easy, safe and economical. By securing the element 6 to the unit 7 solely by a small screw, or other alternative securing devices, one helps to facilitate assembling and disassembling processes while assuring especially high strength and life. Moreover, as it will be apparent to one skilled in the art, headset 5 can be of relatively great sizes, in particular its outer face resting against the skull side corresponding to the mastoid bone, and this, together with the headset itself being made of a soft material, helps in making the device incorporating the transducer according to the invention less troublesome to wear. It has been further found that this particular transducer construction, in which the vibrating unit is directly connected only to one soft material headset intended to directly contact the mastoid bone, and hanging therefrom, allows the pressure required to get a good connection with the mastoid bone is markedly reduced with respect to what can be obtained with prior art transducers; in particular, it has been found that it is enough to use a pressure of about 100-150 g versus 250 g required with known transducers.

What is claimed is:

1. An osseous conduction acoustic transducer comprising:

a hollow housing;

a vibrating unit placed inside the hollow housing;

an acoustic coupling element for coupling with the mastoid bone, generally discoid in shape and having one face directed to the outside of the housing and one face arranged toward the inside of the housing, wherein the acoustic coupling element is comprised by a headset, made from a soft material, which closes one opening made onto a face of housing;

wherein the headset is inserted into an opening of an element and therein locked by a flange of said element placed into a groove of the headset; and connecting means between the vibrating unit and the acoustic coupling element, the connecting means supporting the vibrating unit hanging within said housing so as to allow the connecting means to vibrate, wherein the connecting means includes a plate restrained in a circular housing obtained into the face of the headset directed to the inside of the circular housing.

2. Transducer according to claim 1, wherein the plate is provided, on its face directed to the vibrating unit, with a peduncle having a hole, and coupled to the vibrating unit by means of the peduncle locked by means of a screw.

3. Transducer according to claim 1, wherein the plate includes two flanges with respective holes, and by means of flanges it is connected to vibrating unit through an elastic pin running through the holes.

4. Transducer according to claim 1, wherein the plate includes two flanges provided with respective hooks fitted in corresponding seats integral with the vibrating unit.

5. Transducer according to claim 1, wherein the plate includes a peduncle provided with one oversized end inserted into an elastic slot integral with the vibrating unit.

6. Transducer according to claim 1, wherein the plate includes two hook shaped flanges inserted in one pin integral with the vibrating unit.

7. Transducer according to claim 1, wherein the hollow housing is part of a device worn or otherwise used by a user.

8. Transducer according to claim 7, wherein the device worn by the user is a pair of spectacles, said housing being the spectacles leg ending part.

9. An acoustic transducer comprising:

a hollow housing;

a vibrating unit disposed within the housing;

an acoustic coupling element having one face directed to the outside of the housing and one face arranged toward the inside of the housing; wherein the acoustic coupling element is comprised by a headset, made from a soft material, which closes one opening made onto a face of housing;

wherein the headset is inserted into an opening of an element and therein locked by a flange of said element placed into a groove of the headset; and a connecting member disposed between the vibrating unit and the acoustic coupling element and supporting the vibrating unit hanging within the housing so as to allow the connecting member to vibrate wherein the connecting member includes a plate restrained in a circular housing obtained into the face of the headset directed to the inside of the housing.

10. Transducer according to claim 9, wherein the plate comprises a peduncle having a hole, the peduncle coupling the plate to the vibrating unit.

11. Transducer according to claim 9, wherein the plate comprises two flanges having respective holes, said flanges connecting the plate to the vibrating unit through an elastic pin running through the holes.

12. Transducer according to claim 9, wherein the plate comprises two flanges having respective hooks fitted in corresponding seats integral with the vibrating unit.

13. Transducer according to claim 9, wherein the plate comprises a peduncle provided with one oversized end inserted into an elastic slot integral with the vibrating unit.

14. Transducer according to claim 9, wherein the plate comprises two hook-shaped flanges inserted in one pin integral with the vibrating unit.

15. Transducer according to claim 9, wherein the hollow housing is part of a device worn or otherwise used by a user.

16. Transducer according to claim 15, wherein the device worn by the user is a pair of spectacles, said housing being the spectacles leg ending part.

* * * * *